US006429834B1

(12) United States Patent
Kanazawa et al.

(10) Patent No.: US 6,429,834 B1
(45) Date of Patent: Aug. 6, 2002

(54) PLASMA DISPLAY DEVICE

(75) Inventors: Yoshikazu Kanazawa; Shigeharu Asao, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/421,402

(22) Filed: Oct. 21, 1999

(30) Foreign Application Priority Data

Dec. 8, 1998 (JP) ..... 10-348542

(51) Int. Cl.[7] ..... G09G 3/28
(52) U.S. Cl. ..... 345/63; 345/66
(58) Field of Search ..... 345/60, 62, 63, 345/66, 67, 68, 204, 208; 315/169.4; 313/484, 581

(56) References Cited

U.S. PATENT DOCUMENTS 5,663,741 A * 9/1997 Kanazawa ..... 345/66
6,020,687 A * 2/2000 Hirakawa et al. ..... 345/60
6,023,258 A * 2/2000 Kuriyama et al. ..... 345/60
6,198,476 B1 * 3/2001 Hong et al. ..... 315/169.4

FOREIGN PATENT DOCUMENTS

JP 7-160218 6/1995
JP 9-68945 3/1997
JP 9-185343 7/1997

* cited by examiner

*Primary Examiner*—Regina Liang
(74) *Attorney, Agent, or Firm*—Staas & Halsey LLP

(57) ABSTRACT

A plasma display panel device according to the present invention is provided for preventing a generation of unevenness of luminance caused by lowering a discharge voltage applied to cells according to a difference between display load rates. To achieve the above-described objects, the plasma display device according to the present invention employs a phenomenon where voltage drops applied to cells become larger according to a display load rate at a sustain discharge period, as the luminance becomes lower and wall charges accumulated on the cells after the sustain discharge becomes lower as well. In other words, the present invention is characterized in that a prescribed erase pulse and sustain discharge pulse are applied to X and Y electrodes in the sustain discharge period. When the display load rate is lower, a scale of the sustain discharge at each cell is larger and the amount of wall charges at each cell is not lower. Therefore, the plasma display device according to the present invention selectively erases, by applying the prescribed erase pulse, only the cells where a scale of the sustain discharge is large enough to generate sufficient luminance, and compensates the luminance, by generating the sustain discharge due to the sustain discharge pulse thereafter, for the cells where a scale of the sustain discharge is small not enough to generate the sufficient luminance.

16 Claims, 15 Drawing Sheets

Plain view of an AC type surface discharge PDP device having three electrode structure Cross sectional view of an AC type surface discharge PDP device having three electrode structure Cross sectional view of an AC type surface discharge PDP device having three electrode structure Block diagram of a driver circuit of an AC type serface discharge PDP device having three electrode structure First explanatory diagram of a luminance compensation process Second explanatory diagram of a luminance compensation process Relationship of a display load rate, voltage drop and luminance Relationship between a display load rate and an amount of wall charges Explanatory diagram of light-emitting cells for luminance compensation in a luminance compensation period Modified example Modified example Relationship between a number of sustain cycles and luminance Relationship between a number of sustain cycles and a luminance compensation cycle Relationship between a display load rate and the compensated luminance Example of a number of sustain cycles and a luminance compensation cycle

PLASMA DISPLAY DEVICE

BACKGROUND OF THE INVENTION

1. Field of the Invention

The present invention relates to a plasma display panel (PDP) device, and more particularly to a plasma display device for preventing from generating unevenness of luminance due to voltage drop in discharge electrodes or a driver circuit caused by a discharge current during a sustain discharge period.

2. Description of the Related Art

A PDP device has been expected as a display device having a panel, of which luminance is higher than that of a liquid crystal panel, having a wide angled field of view. In particular, an AC-type surface discharge PDP device having three electrode structures for full color display has been actively developed.

In a driving method of the PDP device, discharges is generated between address electrodes and X or Y electrodes provided faced to the address electrodes in an address period, depending on display data, so that wall charges are formed on cells. In a sustain discharge period, surface discharges are then repeated for the cell where the wall charges are accumulated by applying an AC voltage between the X and Y electrodes in the sustain discharge period. A gray scale can be displayed on each cell by controlling a number of the surface discharges according to its gradation.

It is called a sustain discharge to repeat generating the surface discharges by applying the AC voltage between the above described X and Y electrodes. The sustain discharge voltage is set so as that the sum of the voltage generated by the wall charges accumulated in the address period and the sustain discharge voltage would be a sufficient value enough to generate a new discharge and to keep the wall discharges.

A discharge scale becomes different according to the voltages applied between the X and Y electrodes on the cells in the sustain discharge period. As the applied voltage is higher, the charge scale becomes larger, and luminance for light-emission becomes larger. However, since the discharge currents flows between X and Y electrodes in the sustain discharge period, the total value of the discharge currents becomes different according to a number of the cells where the discharge occurs on the same X and Y electrodes. As the number of the discharged cells becomes larger, therefore, the discharge current becomes larger, thus increasing voltage drops on the X, Y electrodes and driver circuits. As a result, even if the same sustain discharge voltage is applied between the X and Y electrodes, the applied voltages in the cells become different and the generated luminance becomes different case by case. This results in displaying the luminance differed from a prescribed luminance, and causes unevenness of the luminance. It is not preferable to use as a display device.

In the conventional device, it has been proposed to control the number of the sustain discharges by detecting the number of the discharged cells to prevent the unevenness of luminance. For example, a circuit for controlling the number of the sustain discharges has been proposed in the Japanese Unexamined Patent Publication No. 9-68945. However, the proposed circuit is complex, and therefore, there is a demand to further improve the circuit.

Additionally, it has been proposed in the Japanese Patent Application No. 9-185343, for example, that similar voltage drop occurs in the X electrode driving circuit for commonly applying the voltages to the X electrodes in the sustain discharge period, it is prevented from generating the unevenness of luminance in each sub-field thereby. The PDP device according to the invention is also employed to count the number of the discharged cells in each sub-field and correct the sustain discharge periods according to the number of the discharged cells. However, the PDP device according to the later case can cope with the unevenness of luminance between sub-fields, but it can not solve the problem of the unevenness of luminance within a display panel at the same sub-field.

As are described above, the circuitry structures in the conventional methods have complex structures, and therefore, the unevenness of luminance on each cell can not be prevented.

SUMMARY OF THE INVENTION

Accordingly, it is an object of the present invention to provide a PDP device, by which unevenness of luminance can be prevented on each cell, with a simple circuitry structure.

It is another object of the present invention to provide a PDP device for preventing from generating unevenness of luminance in each cell or each display line, according to a number of the sustain discharged cells, i.e., a display load rate at a sustain discharge period.

It is another object of the present invention to provide a PDP device, by which required luminance can be automatically compensated according to insufficiency of luminance.

To achieve the above-described objects, the plasma display device according to the present invention employs a phenomenon where voltage drops applied to cells become larger according to a display load rate at a sustain discharge period, the luminance becomes lower and wall charges accumulated on the cells after the sustain discharge becomes lower as well. In other words, the present invention is characterized in that a prescribed erase pulse and sustain discharge pulse are applied to X and Y electrodes in the sustain discharge period. When the display load rate is lower, a scale of the sustain discharge at each cell is larger and the amount of wall charges at each cell is not lower. Therefore, the plasma display device according to the present invention selectively erases, by applying the prescribed erase pulse, only the cells where a scale of the sustain discharge is large enough to generate sufficient luminance, and compensates the luminance, by generating the sustain discharge due to the sustain discharge pulse thereafter, for the cells where a scale of the sustain discharge is small not enough to generate the sufficient luminance.

The above-described objects can be achieved by a plasma display device having a display panel including plural cells being selectively discharged according to display data and a driver circuit for driving the display panel, wherein the driver circuit causes an address discharge at a cell according to the display data, causes a sustain discharge at the cell where the address discharge is generated by applying sustain discharge pulses alternatively between X and Y electrodes provided along display lines, and further causes a luminance compensation discharge at, at least, a part of the cells by applying an erase pulse and an additional sustain discharge pulse following to the erase pulse between the X and Y electrodes.

DESCRIPTION OF THE PREFERRED EMBODIMENTS

Hereinafter, embodiments of the present invention will be explained in conjunction with the accompanying drawings. However, it should be understood that technical concept of the present invention is not restricted to the embodiments.

Figure 1:
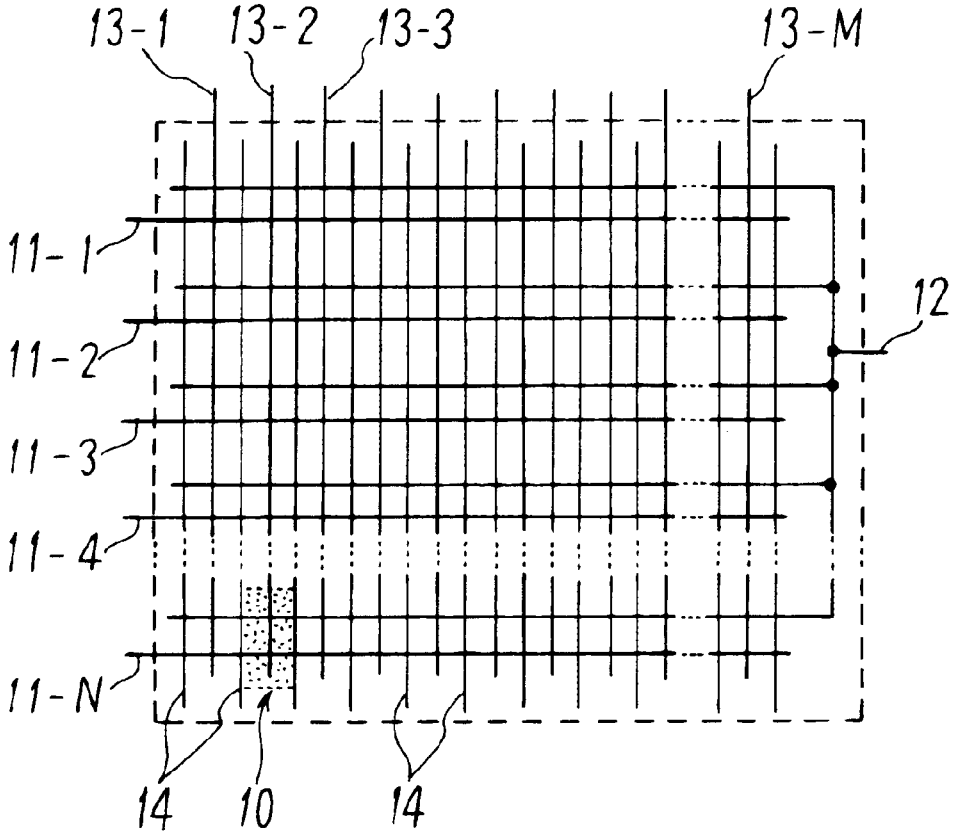
FIG. 1 is a plain view of a PDP device according to an embodiment of the present invention.

FIG. 1 is a plain view of a PDP device according to an embodiment of the present invention. The PDP shown in FIG. 1 is an AC type surface discharge PDP having three electrode structure. In other words, the PDP has a first substrate having plural address electrodes 13-1 to 13-M extending toward a vertical direction and a second substrate having plural X electrodes 12 and Y electrodes 11-1 to 11-N extending toward a horizontal direction. The X electrodes 12 are commonly connected in a panel or in a prescribed area. The PDP device further has ribs 14 provided between the address electrodes 13 for partitioning each cell. Additionally, the PDP device has discharge cell areas 10 disposed on intersections between display lines formed of the X electrodes 12 and the Y electrode 11 and the address electrodes 13.

Figure 2:
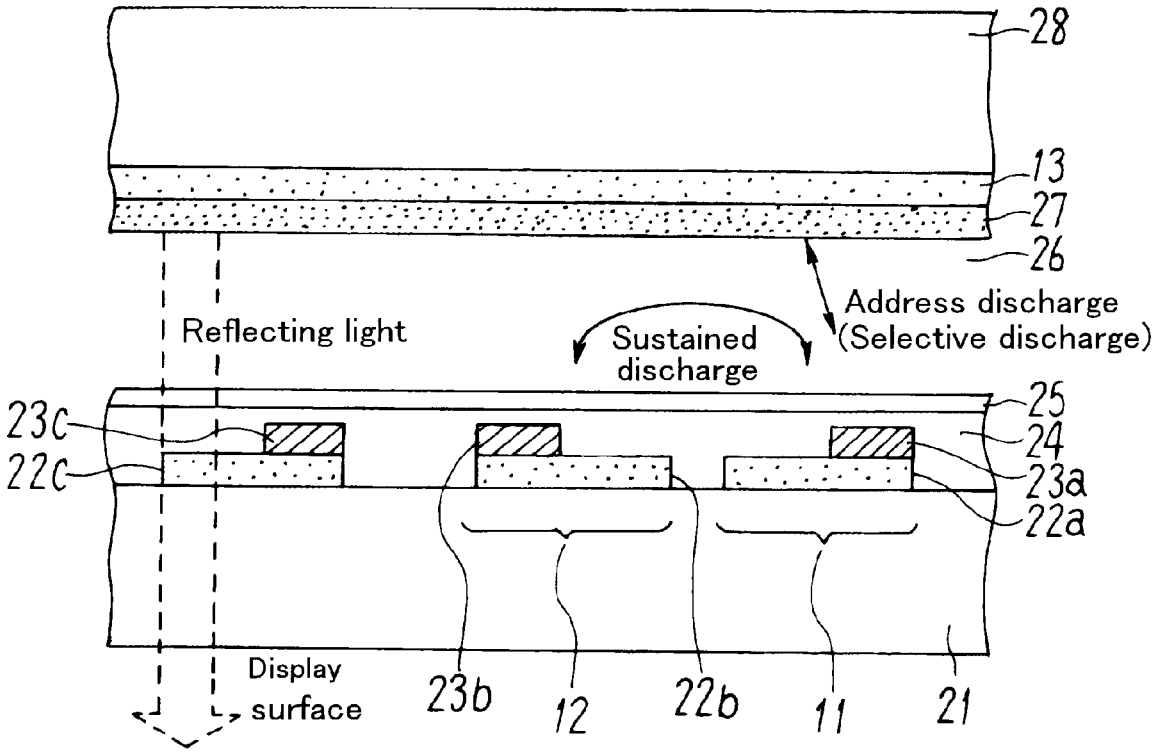
FIG. 2 is a cross sectional view of the PDP device according to an embodiment of the present invention.
Figure 3:
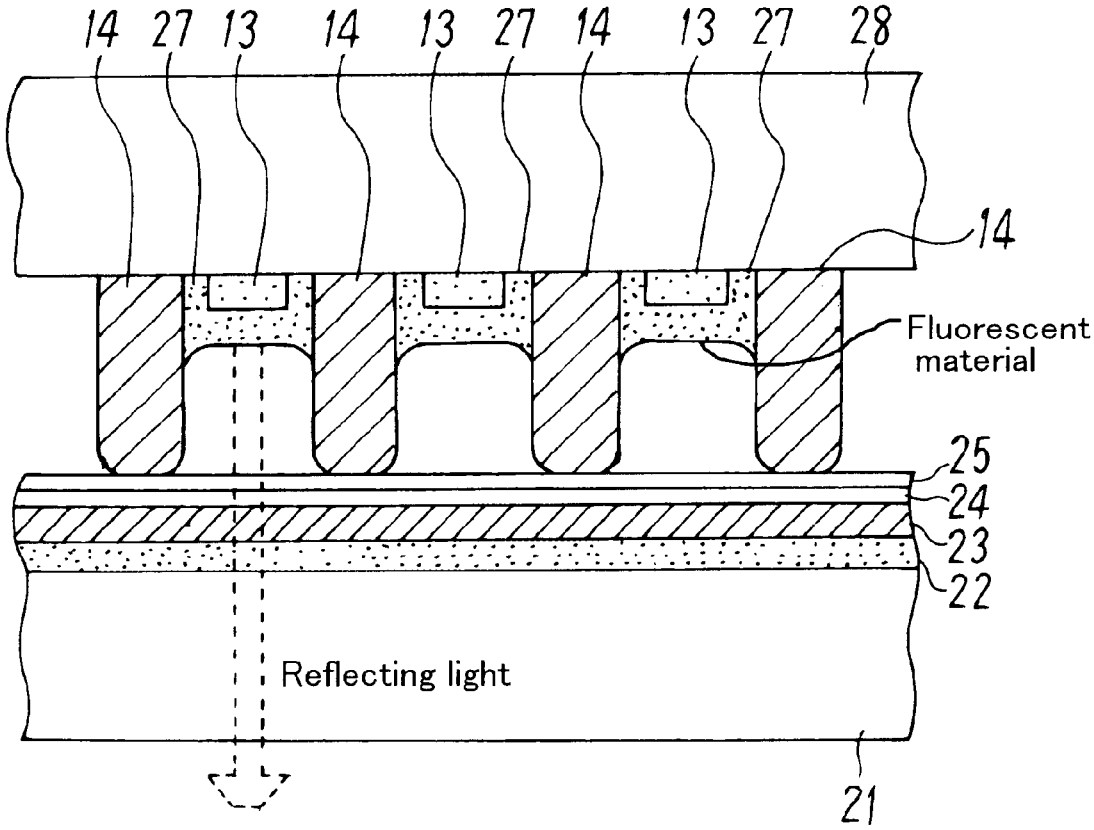
FIG. 3 is a cross sectional view of the PDP device according to an embodiment of the present invention.

FIGS. 2 and 3 are cross sectional views of the PDP device according to an embodiment of the present invention. FIG. 2 is a cross sectional view of a portion taken along the address electrode 13, and FIG. 3 is a cross sectional view of a portion taken along a display line, i.e., the X electrode 12 or Y electrode 11.

The PDP device has a rear first substrate 28 on which there are disposed address electrodes 13. Ribs 14 made of dielectric materials are disposed in positions between the address electrodes 13. A fluorescent material 27 for covering the address electrode 13 is formed between the ribs 14. The PDP device further has a second substrate 21 positioned on a display side where there are disposed transparent electrodes 22*a* and 22*b* forming the Y electrode 11 and the X electrode 12, and auxiliary electrodes 23*a* and 23*b* made of metals for giving a higher conductivity to the transparent electrodes 22*a* and 22*b*. The X electrode 12 and the Y electrode 11 are covered with a dielectric layer 24, and the dielectric layer 24 is further covered with a magnesium oxide layer 25 as a protective layer. Additionally, a discharge space 26 is disposed between the first and second substrates 21 and 28.

When a predetermined address pulse is applied to the address electrodes 13 in an address period according to display data, and a scanning pulse is applied to the Y electrodes 11, a high voltage is applied between the address electrodes 13 and the Y electrodes 11 at the intersections therebetween, and therefore, an address discharge occurs between the both electrodes. Wall charges generated by the address discharge are accumulated on the surface of the dielectric layer 24 of the Y electrode 11.

When alternating sustain discharge pulses are applied between the X electrode 12 and the Y electrode 11 in a sustain discharge period after the address period, a sustain discharge occurs alternately between the X electrodes 12 and the Y electrodes 13 only for lit cells where the address discharge occurs, according to a total of the voltage generated by the accumulated wall charges and the voltage generated by the sustain discharge pulse. A luminance value in each cell can be controlled by the number of the sustain discharges.

Figure 4:
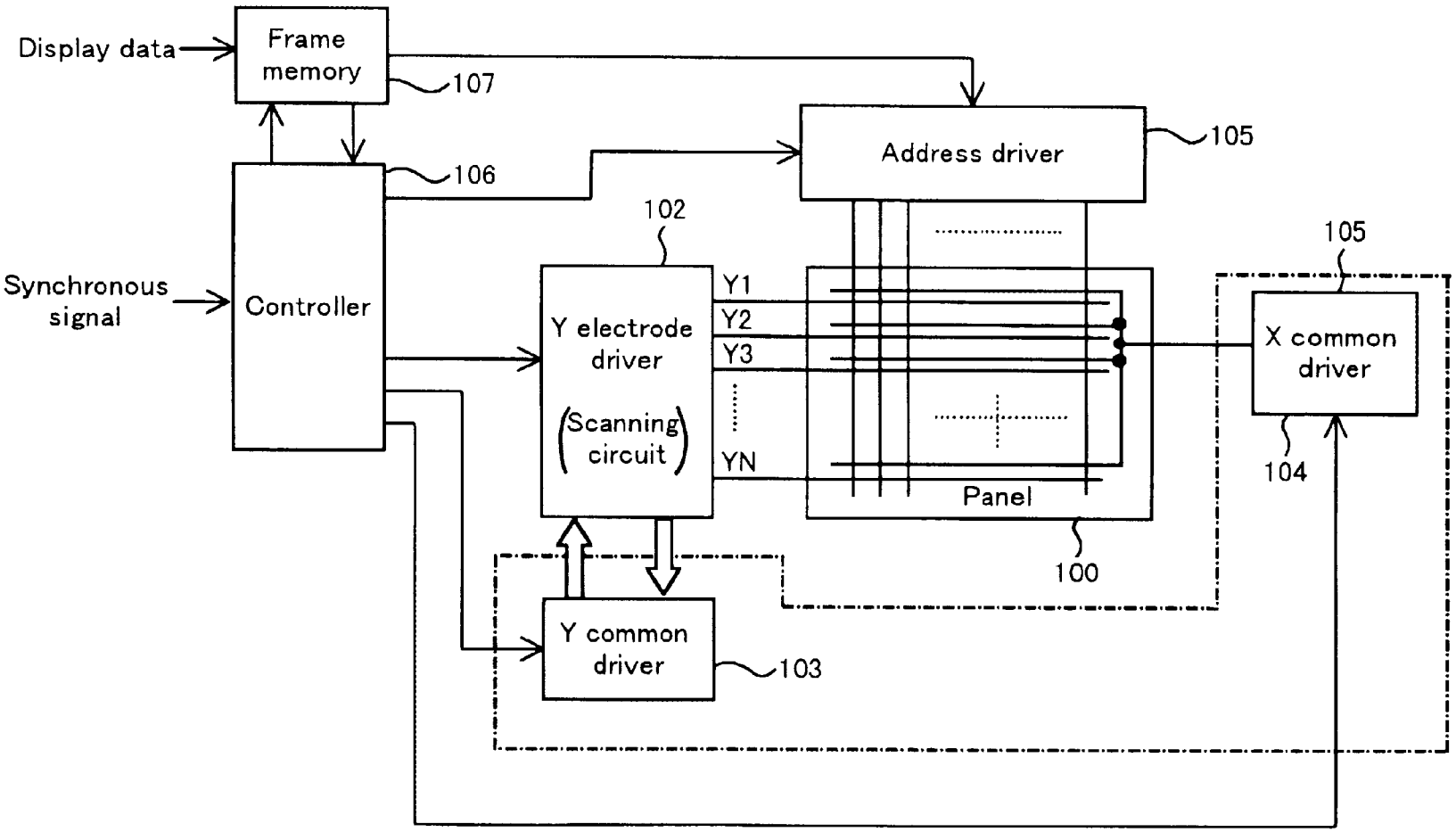
FIG. 4 is a block diagram of a driver circuit of the PDP device according to an embodiment of the present invention.

FIG. 4 shows a block diagram of a driver circuit of the PDP device according to an embodiment of the present invention. The PDP device of FIG. 4 has a plasma display panel 100 and a driver circuit for driving the panel 100. The driver circuit has a frame memory 107 for temporally storing display data and a control section 106, to which a synchronous signal is supplied, for supplying a timing signal to each driver circuit. The driver circuit further has an address driver 105 for applying an address pulse to the address electrodes 13, according to the display data output from the frame memory 107, in response to the timing signal output from the control section 106. Additionally, the driver circuit has a Y electrode driver 102 for subsequently applying a scanning pulse to the Y electrode 11, in response to the timing signal output from the control section 106, in the address period, and supplying the sustain discharge pulse, which is supplied from a Y common driver 103, to the Y electrode 11, in response to the timing signal, in the sustain discharge period. The driver circuit further has a X common driver 104 for supplying the sustain discharge pulse to the X electrode 12, in response to the timing signal output from the control section 106, in the sustain discharge period.

Figure 5:
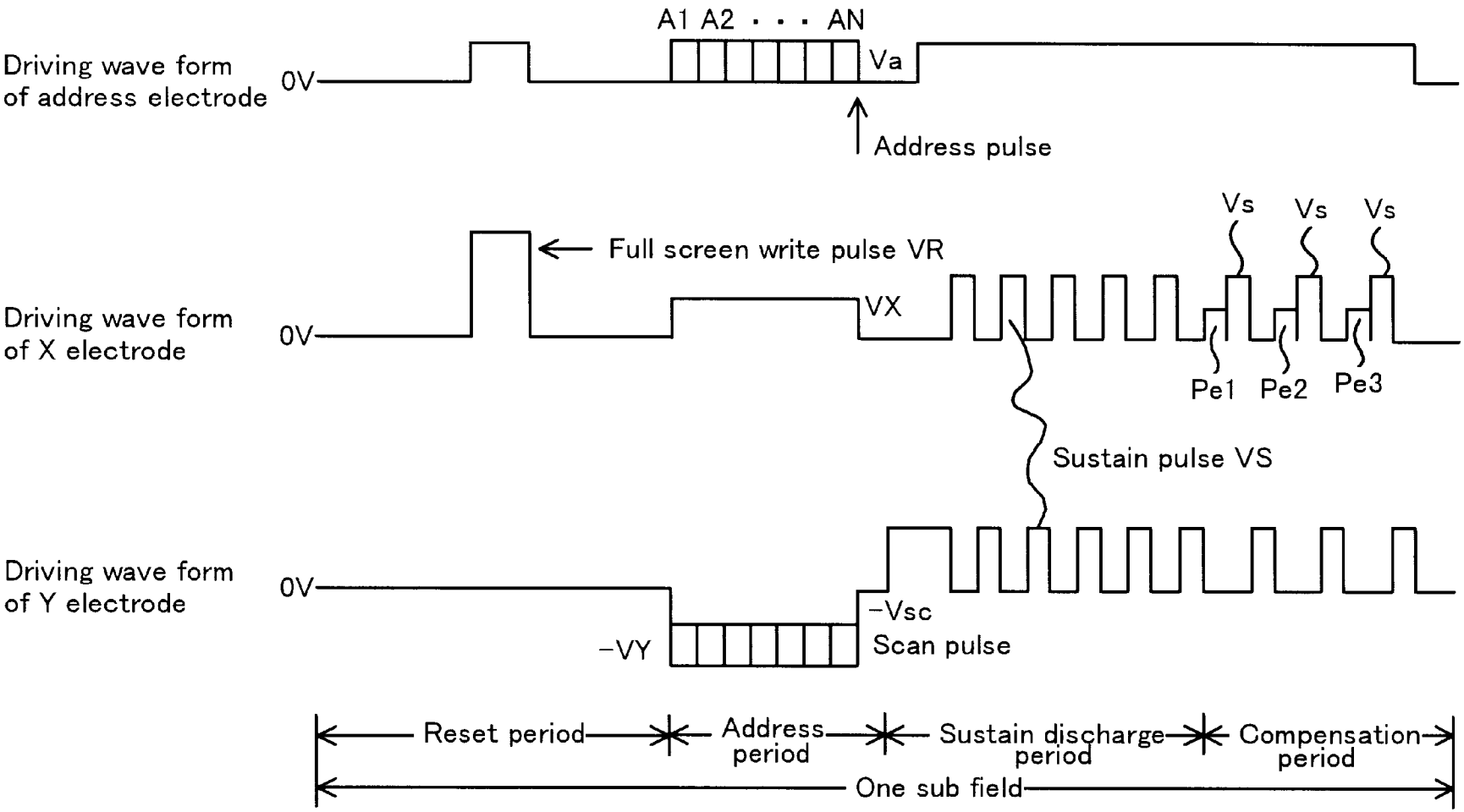
FIG. 5 shows an example of a driving waveform of the PDP device according to an embodiment of the present invention.

FIG. 5 shows an example of a driving waveform of the PDP according to an embodiment of the present invention. In FIG. 5, a driving waveform of the address electrode and driving waveforms of the X and Y electrodes in one sub-field are shown. When displaying one frame image, the PDP device is driven by driving the plural sub-fields each being weighted by its gradation, and a display with half-tone is performed by a combination of the sub-fields. One sub-field includes at least a reset period, an address period, and a sustain discharge period, as shown in FIG. 5. The sustain discharge period in each sub-field is set according to the gradation set in each sub-field. Additionally, the predetermined sub-field has a compensation period for luminance compensation after the sustain discharge period, according to the embodiment of the present invention.

A full screen write pulse VR is applied to the commonly connected X electrodes 12 in the reset period. They electrodes 11 is then kept to 0V. As the result, a high voltage of the full screen write pulse VR is applied between the X electrodes 12 and the Y electrodes 11, and a discharge occurs between the X electrodes 12 and the Y electrode 11 at all cells. Wall charges generated by the discharge are formed on all cells. When the full screen write pulse VR falls down, the reversed voltage due to the wall charges generated by the above discharge is applied between the X electrodes 12 and the Y electrodes 11, thus generating the reversed discharge again. However, there is no supplement of new energy for the discharge, and therefore, the wall charges are not accumulated on all cells. This results in resetting all cells.

A predetermined intermediate voltage Vx is applied to the X electrodes 12, and a negative scanning pulse −Vy is subsequently applied to the Y electrodes 11 in an address period after the resetting period. An address pulse Va is selectively applied to the address electrodes 13 according to the display data in synchronism with the apply of the scanning pulse −Vy to the Y electrodes 11. As the result, a voltage Va+Vy required for discharging between both electrodes is applied to the cells positioned at the intersection between the address electrodes, to which the address pulse Va is applied, and the Y electrode, to which the scanning pulse −Vy is applied, so that the address discharge is generated at the cells. The generation of the address discharge causes the wall charge accumulation on the dielectric layer 24 on the Y electrodes 11 and the address electrodes 13.

When a scan is finished after the scan pulse is applied to the all Y electrodes 11 in the address period, it becomes the sustain discharge period. In the sustain discharge period, the sustain discharge is generated for the cells where the address discharge is generated corresponding to the gradation allocated to the sub-field. Further, the sustain discharge pulse Vs is alternately applied between the Y electrodes 11 and the X electrodes 12. That results in applying the alternative pluses between the both electrodes plural times. Considering to add the energy of the accumulated wall charges, the energy generated by the sustain discharge pulse Vs is set enough to generate the sustain discharge. In detail, the voltage and the pulse width of the sustain discharge pulse Vs are set as described above. Therefore, a predetermined number of sustain discharges occurs between the X electrodes and the Y electrodes only for the cells discharged in the address period.

In the embodiment of the preset invention, a compensation discharge period for luminance compensation is provided after the sustain discharge period in all sub-fields or a predetermined sub-field. In the compensation discharge period, an erase pulse Pe having a predetermined voltage, pulse width or waveform and a sustain discharge pulse Vs followed to the erase pulse Pe are applied to the commonly connected X electrodes. The sustain discharge pulse Vs is applied to the Y electrodes, similarly to the sustain discharge period.

An erase discharge occurs at the cells each having a enough discharge scale in the sustain discharge period by applying the erase pulse Pe, so that the wall charges thereof are disappeared. Additionally, no erase discharge occurs at the cells having not enough discharge scale in the sustain discharge period by applying the erase pulse Pe, thus the wall charges thereof are maintained. Therefore, additional sustain discharge is generated at the cells according to the following sustain pulse. As the result, the luminance can be compensated for the cells where a discharge scale is too small to generate desired luminance in the sustain discharge period.

Various methods can be employed to apply the erase pulse and the sustain discharge pulse in the luminance compensation discharge period. For example, it becomes possible to generate a number of compensation discharges according to insufficiency of the luminance of the cells by applying the plural combinations of the erase pulse and the sustain discharge pulse. Additionally, it also becomes possible to give compensation of luminance only for sub-field, which gives larger effect to unevenness of luminance by providing a compensation discharge period only in the sub-field having more gradation than a predetermined level. These modified example will be described later.

Figure 6:
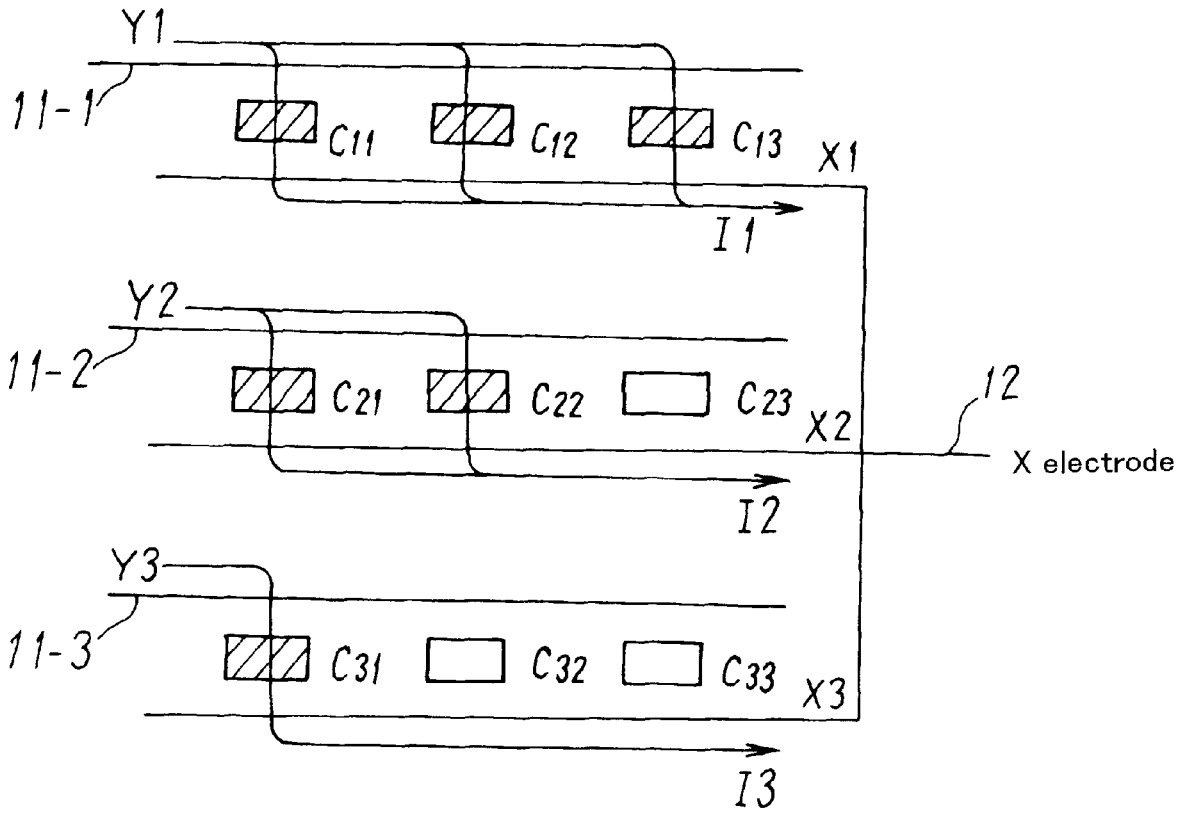
FIG. 6 is a first explanatory diagram of a luminance compensation process.
Figure 7:
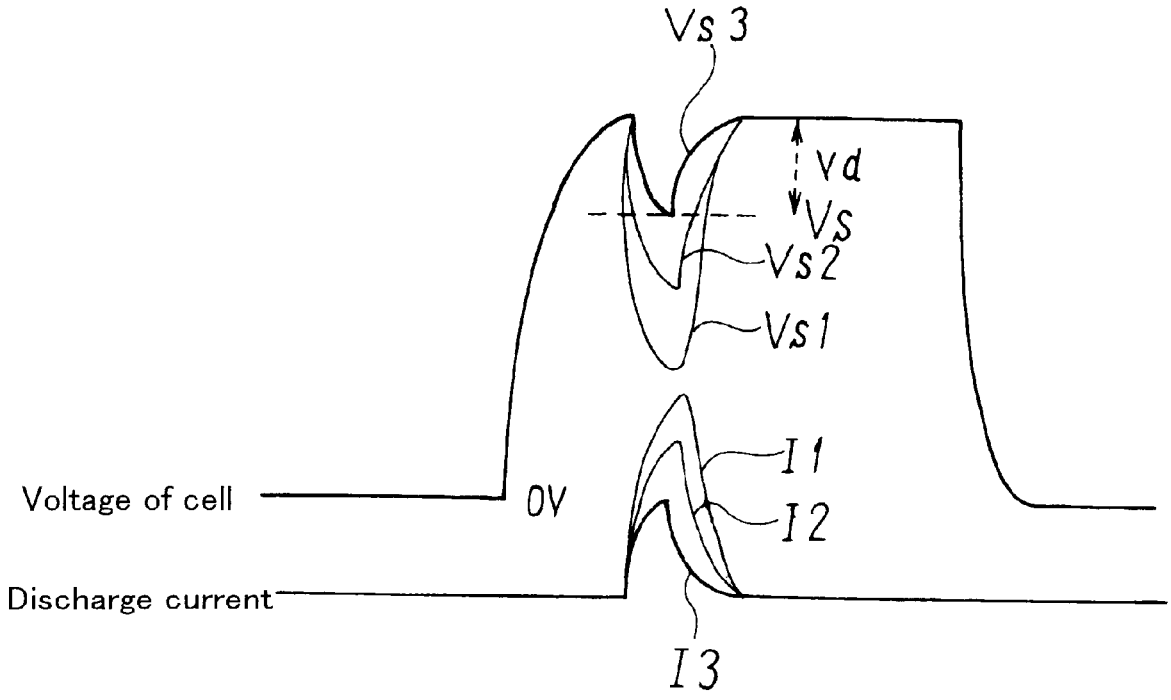
FIG. 7 is a second explanatory diagram of a luminance compensation process.

FIGS. 6 and 7 are explanatory diagrams of a luminance compensation process. In FIG. 6, cells C11 to C33 arranged in three columns and three lines, an X electrode 12 and Y electrodes 11-1 to 11-3 corresponding to the cells C11 to C33 are shown for simplicity. The cells C11 to C13 are respectively arranged between the X electrode X1 and the Y electrode Y1, the cells C21 to C23 are arranged between the X electrode X2 and the Y electrode Y2, and the cells C31 to C33 are arranged between the X electrode X3 and the Y electrode Y3. It is assumed in this example that an address discharge is generated for the cells C11 to C13 in a first display line, an address discharge is generated for two cells C21 and C22 in a second display line, and an address discharge is generated only for one cell C31 in a third display line.

As is described above, when the sustain discharge occurs for cells, where the address discharge occurs, by applying the sustain discharge pulse Vs to the Y electrodes in the sustain discharge period, a voltage applied between the X electrodes and the Y electrodes and the discharge current in each cell are as shown in FIG. 7. In other words, the sustain discharge occurs for three cells C11, C12 and C13 between the X electrode X1 and the Y electrode Y1. Therefore, a very large discharge current I1 flows from the Y electrode Y1 to the X electrode Y1 when the discharge occurs. A voltage drop occurs at X electrode and Y electrode according to the discharge current I1. Alternatively, a voltage drop occurs in the Y electrode driver or the X electrode driver, not shown in the diagram. The voltage drop is approximately proportional to the size of the discharge current I1. The voltage applied to the cells C11 to C13, as shown as a voltage Vs1 in FIG. 7, is, therefore, lower than the voltage of the sustain discharge pulse Vs, as shown as a voltage Vs1 in FIG. 7.

On the other hand, as only two cells C21 and C22 are energized in the second display line formed of the X electrode X2 and the Y electrode Y2, the discharge current I2 becomes smaller than the above-described discharge current I1. According to that, the voltage drop for the cells is smaller than the above-described voltage Vs1, as shown as Vs2 in FIG. 7. As only one cell C31 is energized in a third display line formed of display electrodes X3 and Y3, a discharge current I3 becomes smaller than any other currents I1 and I2 described above, and the voltage drop Vd for the cell is smaller than that for any other voltages Vs1 and Vs2, as shown as Vs3 in FIG. 7.

In this case, in the first display line having the maximum number of lit cells, the energy applied to each cell is the smallest and the discharge scale is also the smallest for the same sustain discharge pulse. Therefore, the luminance in the first display line is the lowest. Additionally, in the third display having the minimum number of lit cell, the energy applied to the cell C31 is the largest, the discharge scale is also the largest, and the largest luminance can be generated at the cell C31.

It is therefore expressed in this specification that a display load rate becomes higher in the first display line, and the display load rate becomes lower on the third display line, in the case of FIG. 6, because loads for displaying images becomes larger according to the number of the lit cells.

Figure 8:
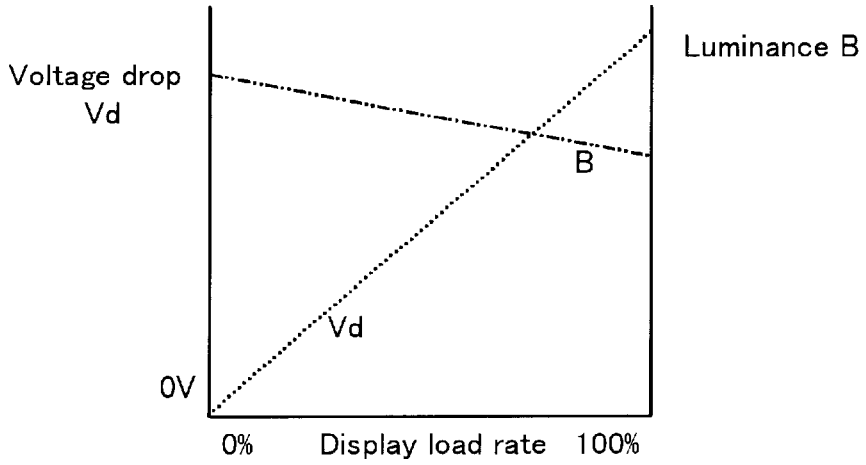
FIG. 8 illustrates a relationship of a display load rate, voltage drop and luminance.

FIG. 8 shows a relationship of the display load rate, the voltage drop and the luminance. The axis of abscissas shows a display load rate, and the axes of ordinates shows a voltage drop Vd and luminance B in FIG. 8. As are shown in FIGS. 6 and 7, as the display load rate becomes higher, the voltage drop Vd becomes larger and the luminance B becomes lower. On the other hand, when the display load rate becomes lower, the voltage drop Vd becomes smaller, and the luminance B becomes higher.

Figure 9:
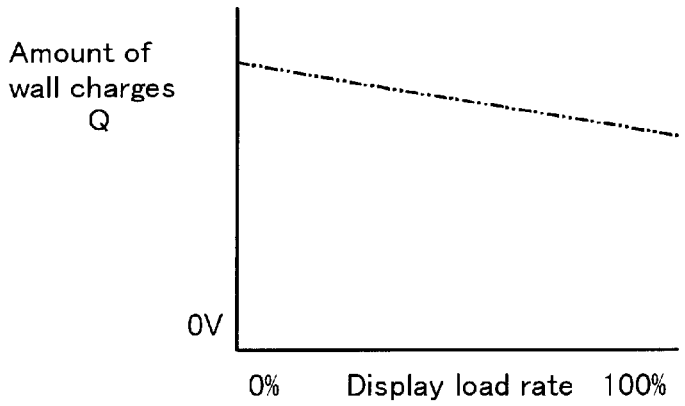
FIG. 9 illustrates a relationship between a display load rate and an amount of wall charges.

FIG. 9 shows a relationship between the display load rate and the amount of wall charges accumulated in a cell. The axis of abscissas shows a display load rate and the axis of ordinates shows an amount Q of the wall charges. When the display load rate becomes higher, the voltage drop Vd for the voltage applied to the cell becomes larger and a discharging scale at the sustained discharging time becomes smaller. Thereby, it is considered that the amount Q of wall charges accumulated on the cell becomes smaller. On the other hand, when the display load rate becomes lower, the voltage drop Vd for the voltage applied to the cell becomes smaller and the discharging scale at the sustain discharge period becomes larger. Thereby, it is considered that the amount Q of the wall charges accumulated on the cell becomes larger.

It is noted in the embodiment of the present invention that the lowering of the luminance B for the display load rate tends to being similar to that of the amount Q of the wall charges. Therefore, an erase pulse is employed in the luminance compensation period to automatically add the luminance compensation discharge only for cells where the luminance is insufficient.

Figure 10:
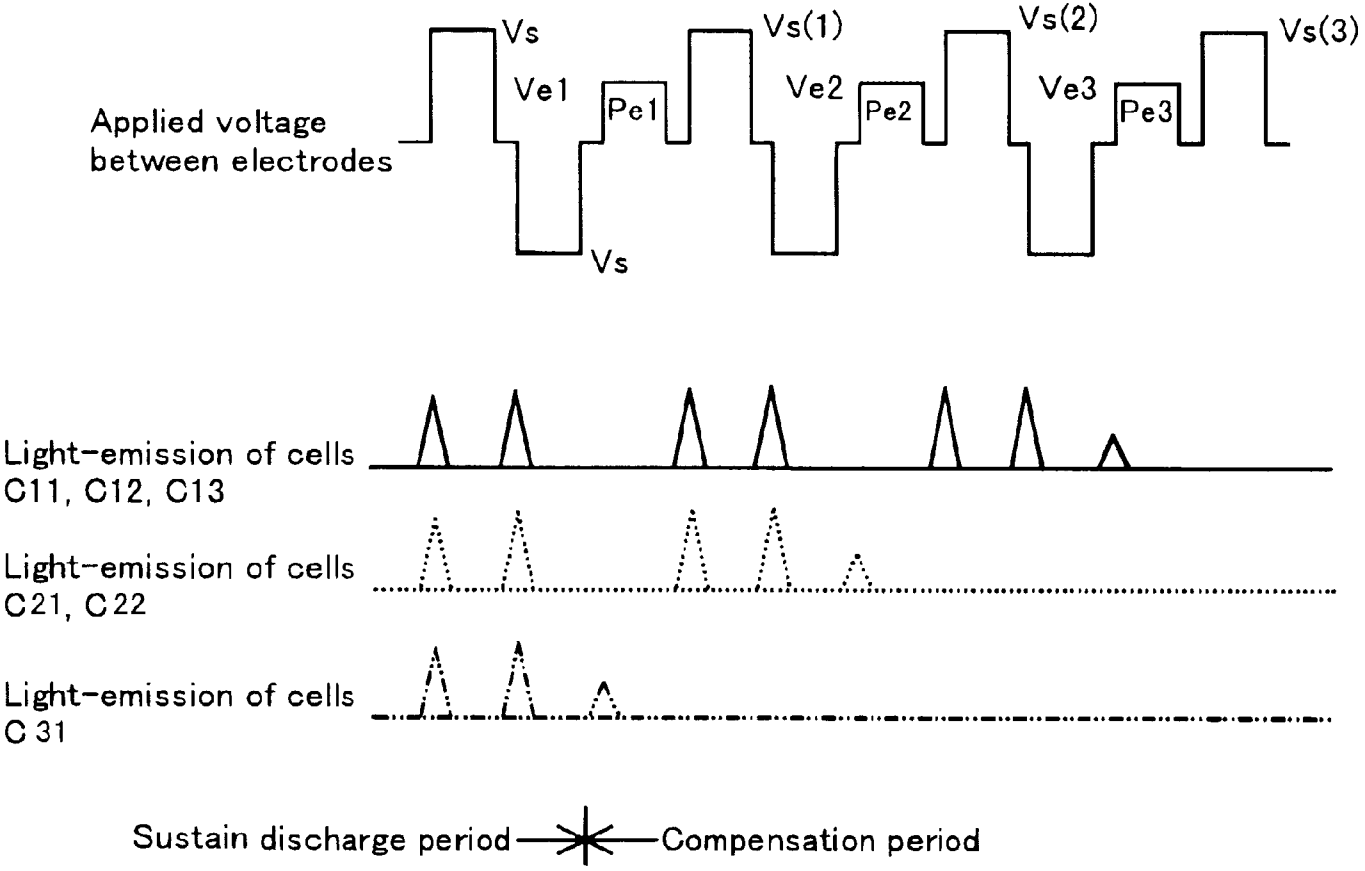
FIG. 10 is an explanatory diagram of light-emitting cells for luminance compensation in a luminance compensation period.

FIG. 10 is an explanatory diagram of light-emitting for luminance compensation for cells in a luminance compensation period. In FIG. 10, shown are the voltage applied between the X and Y electrodes of each cell in the compensation period shown in FIG. 5 and the light-emission for luminance compensation to each lit cell shown in FIG. 6. At first, the sustain discharge occurs for all lit cells C11 to C13, C21, C22 and C31 where the address discharges are generated in the address period and light-emission occurs for the cells through a fluorescent material, every time the sustain discharge pulse Vs is applied between the X and Y electrodes in the sustain discharge period before the compensation period.

When an erase pulse Pe1 is applied in the luminance compensation period, an erase discharge occurs for the cell C31 in the third display line where the sustain discharge scale is the largest and the amount of the wall charges is the largest. Light-emission being smaller than the sustain discharge occurs according to the erase discharge. As the applied energy at the erase discharge is small, the wall charges due to the discharge is not generated, and the wall charges are not accumulated at the cell C31 after that. On the other hand, as the cells C21, C22 and C11 to C13 on the second and the first display lines, each of which sustain discharge scale is smaller and amount of the wall charges is smaller, have no sufficient wall charge for erase discharge, even if the erase pulse Pe1 is applied, the erase discharge does not occur.

The sustain discharge pulse Vs(1) is applied between the X and Y electrodes of the cells after applying the erase pulse Pe1. Then, the cell C31 where the wall charge is disappeared by the erase discharge does not discharge for the sustain discharge pulse Vs(1). Therefore, the light-emission is not generated. As the cell C31 has an enough sustain discharge scale because of its low display load rate, so as to light-emit with a sufficient luminance, it is no longer necessary to add the sustain discharges for the luminance compensation. Additionally, the luminance compensation discharge is generated by the sustain discharge pulse Vs(1) at the cells C21, C22 and C11 to C13 where the erase discharge is not generated due to the erase pulse Pe1. At the discharge, sufficient energy is supplied to the cells and the wall charges are accumulated similarly to the normal sustain discharge. However, the number of the cells discharged in response to the sustain discharge pulse Vs(1) reduces only for the cell C31. As the result, the voltage drop due to the commonly connected X electrode 12 becomes smaller than that at the previous sustain discharge, and the voltage applied to the remaining lit cells C21, C22 and C11 to C13 becomes larger only for the reduced voltage drop. Therefore, the amount of the wall charges accumulated in each cell by the discharge due to the sustain discharge pulse Vs(1) increases.

When the second erase pulse Pe2 is applied, the erase discharge occurs for the cells C21 and C22 in the second display line. This is because in this time the amount of the wall charges are accumulated large enough to generate the erase discharge by the erase pulse Pe2 are accumulated in this time. As the result of the erase discharge, the wall charges disappear from the cells C21 and C22. Additionally, as the wall charges are not accumulated large enough to generate the erase discharge at the cells C11 to C13 in the first display line where the sustain discharge scale is the smallest, no erase discharge occurs in response to the erase pulse Pe2. The sustain discharge occurs for the cells C11 to C13 to compensate the luminance, in response to the sustain discharge pulse Vs(2) following to the erase discharge.

When the third erase pulse Pe3 is applied, the erase discharge occurs for the only lighting cells C11 to C13. It is because since all cells on the other display lines are erased during the above-described sustain discharge, and the voltage drop on the commonly connected X electrode is reduced, an enough sustain discharge scale can be ensured for the cells C11 to C13. The wall charges are removed from all cells C11 to C13 by the erase discharge. Therefore, no more sustain discharge occurs by applying the third sustain discharge pulse Vs(3).

When the voltage drop variation on the commonly connected X electrode is smaller in the above-described example, there is a case where no erase discharge occurs for the cells C11 to C13 due to the third erase pulse Pe3. In this case, a third compensation discharge occurs and a third luminance compensation is performed for the cells, in response to the third sustain discharge pulse Vs(3).

The erase pulses Pe1 to Pe3 shown in FIG. 10 have the same pulse width as that of the normal sustain discharge pulse vs, and have voltages Ve1 to Ve3 being lower than that of the normal sustain discharge pulse Vs. The voltage Ve is set so as to generate the erase discharge for the cell belonging to the lower display load rate and not to generate the erase discharge for the cells belonging to the higher display load rate.

For example, the voltage Ve is set so as to generate the erase discharge for the cells in the display line where the display load rate is lower and not to generate the erase discharge for the cells in the display line where the display load rate is higher than the above, even in the same sub-field period. Even if the voltages of the three erase pulses are same in this case, the luminance compensation discharge can be generated according to the luminance condition, as the reduction of the voltage drop of the commonly connected X electrode, as described above. Additionally, when a reduction ratio of the voltage drop of the common X electrode is small, for example, it is effective that the voltages Ve1 to Ve3 of the three erase pulses are gradually higher. In other words, the erase discharge is generated, in response to the voltage Ve of the lower erase pulse, in the order from the small display load rate of each display line. Therefore, the display line having more insufficiency of the luminance during the sustain discharge period can generate, more luminance compensation discharge.

When a plurality groups of the common X electrode are provided in the display panel, in the above-described first example, a timing for generating the erase discharge becomes different according to the display load rate among the display areas of each common X electrode, so that the discharge for luminance compensation can be generated according to the insufficiency of the luminance in each display area.

As the second example, the voltage Ve is set so as to generate the erase discharge in the period where the display load rate is small, and not to generate the erase discharge in the period where the display load rate is higher than the above in different period of the sub-field corresponding to the same luminance. Even if the voltages of the three erase pulses are the same in this case, the added number of the luminance compensation discharges is automatically increased or reduced according to the display load rate in each period. Therefore, as the number of the lit cells in the sub-field is larger, the more luminance compensation discharge can be generated according to the insufficiency of the luminance.

Figure 11A:
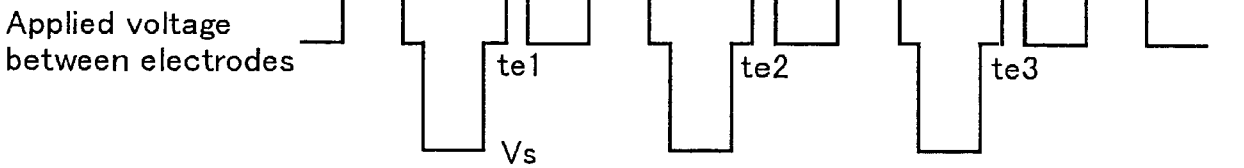
FIGS. 11A and 11B respectively show a modified example of an erase pulse in a luminance compensation period.

FIG. 11 shows a modified example of the erase pulse in the luminance compensation period. In the example of FIG. 10, the voltages of the erase pulses Pe1 to Pe3 are set lower than that of the normal sustain discharge pulse Vs. In the example of FIG. 11A, voltages of the erase pulses Pe1 to Pe3 are the same as that of the normal sustain discharge pulse Vs. However, the pulses has narrower width than that of the normal sustain discharge pulse Vs. The pulse width is set based on the same consideration of setting the voltages in the example of FIG. 10. Further, when the pulse widths of the three erase pulses becomes large, it becomes possible to erase the lit cells in the order of the enough luminance.

Figure 11B:
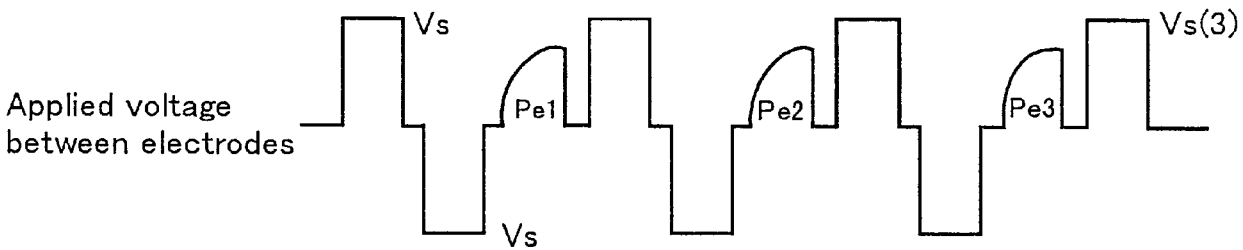

In the example of FIG. 11B, each erase pulses Pe1 to Pe3 rises at a gradient being gentler than that of the normal sustain discharge pulse Vs. When each erase pulse rises at the gentler gradient, the erase discharge is generated with each voltage level, according to the amount of the wall charges accumulated on the applied cells. Therefore, it becomes possible to generate the erase discharge with the minimum energy in each cell, and to remove the wall charges after that almost completely. The gradient is also set according to the same consideration of setting the voltage in the example of FIG. 10.

It is also possible to form the erase pulse by combining either of the voltage lower than that of the normal sustain discharge pulse, the width narrower than the normal pulse or a gentler rising characteristic as explained in FIGS. 10 and 11.

Figure 12:
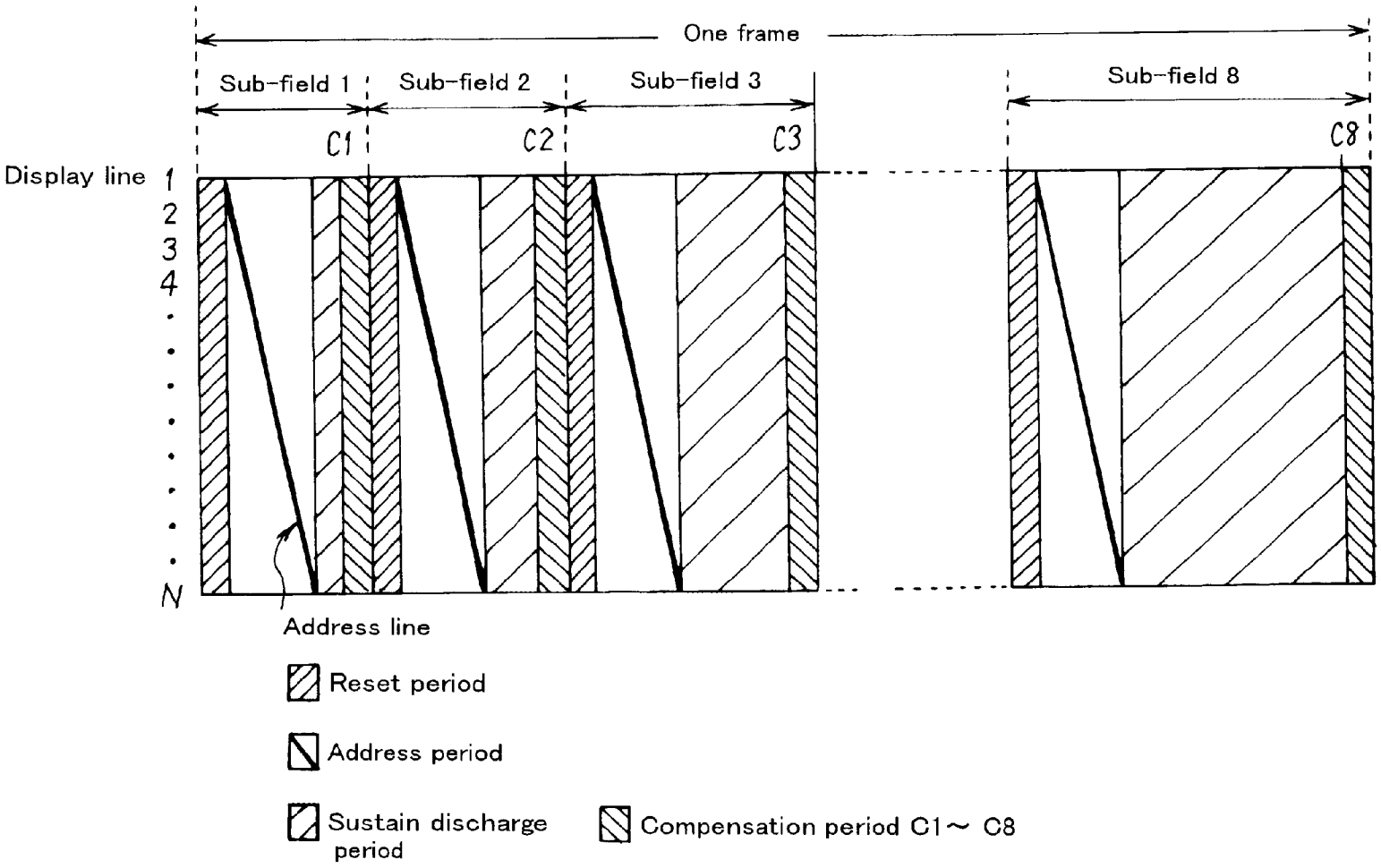
FIG. 12 shows a structure of plural sub-fields in one frame according to an embodiment of the present invention.

FIG. 12 shows a structural example of plural sub-fields in one frame according to the embodiment of the present invention. As is shown in FIG. 5, each sub-field has a reset period, an address period and a sustain discharge period. The sustain discharge period in each sub-field is set so as to be proportional to a gradation (luminance) set in the sub-field. In other words, it is set so as to being the sustain discharge period of the sub-field for displaying a high gradation longer, and being the sustain discharge period of the sub-field for displaying a low gradation shorter.

In the embodiment of the present invention, the luminance compensation periods C1 to C8 are added after the sustain discharge period. The addition makes it possible to add the compensation discharge according to the insufficiency of the luminance for the lit cells where the insufficiency of the luminance occurs in each sub-field, and to compensate the required luminance. In the embodiments of the present invention, there is no need to provide the luminance compensation period for all sub-fields. As is described later, a luminance compensation period may be provided only to the sub-field having a longer sustain discharge period where the insufficiency of luminance remarkably appears. It becomes easy to adapt a time required for the entire drive in one frame period by removing a luminance compensation period from sub-fields where the insufficiency of luminance is not larger.

Figure 13:
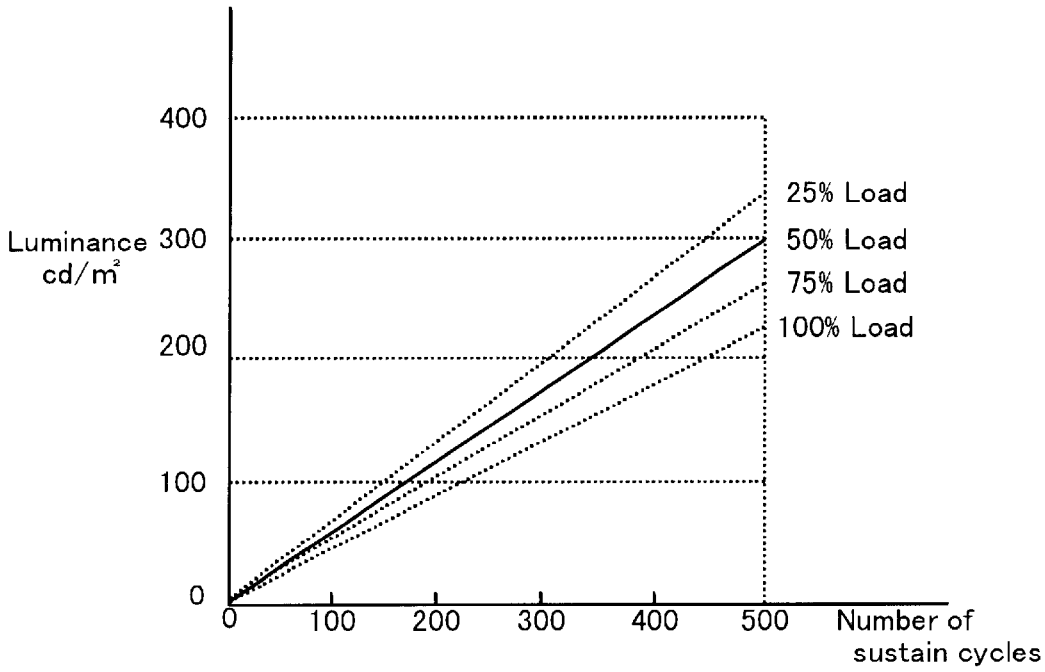
FIG. 13 shows a relationship between a number of sustain cycles and luminance by separating in each display road rate.

FIG. 13 shows a relationship between a number of sustain discharges (a number of sustain cycles) and luminance by separating in each display load rate. The axis of abscissas shows a number of sustain cycles and the axis of ordinates shows luminance. FIG. 13 is an example of the relationship between a number of the sustain cycles and luminance when the display load rate is 25%, 50%, 75% or 100%.

As shown in FIG. 13, as the number of the sustain cycles increases, i.e., as the number of the sustain discharges in the sustain discharge period increases, the luminance is higher. The higher display load rate causes lowering the luminance under the condition of the same number of the sustain cycles. Further, an absolute amount for lowering the luminance becomes larger, as the number of the sustain cycles increases and the display load rate becomes higher.

The present applicants found that assuming eight sub-fields exist in one frame and the number of sustain discharges (the number of sustain cycles) is 500 cycles in the sustain discharge period of the sub-fields, when the number of the lit cells on the display line is 25%, the luminance becomes approximately 340 cd/m$^2$, approximately 300 cd/m$^2$ when 50%, approximately 260 cd/m$^2$ when 75%, and approximately 220 cd/m$^2$ when 100%. Therefore, when the luminance is divided by the number of the sustain cycles 500, the luminance in every one cycle can be obtained as follows:

the display load rate of 25% :0.68 cd/m$^2$;

the display load rate of 50% :0.60 cd/m$^2$;

the display load rate of 75% :0.52 cd/m$^2$; and the display load rate of 100% :0.44 cd/m$^2$.

Figure 14:
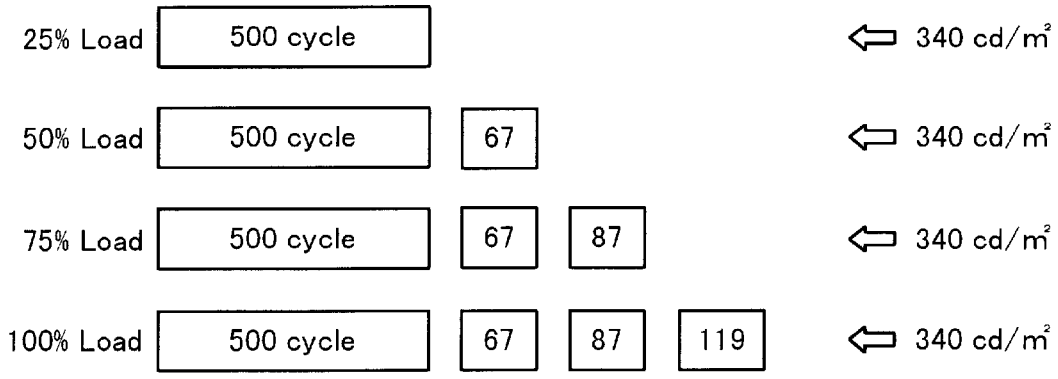
FIG. 14 shows an example of a relationship between a number of sustain cycles and a luminance compensation cycle.

FIG. 14 shows an example of the relationship between a number of sustain cycles and a luminance compensation cycle. According to the above-described result, in case where the number of the sustain cycles is 500, the number of discharges in the luminance compensation period, as shown in FIG. 14, is required to compensate the insufficiency of the luminance for respective display load rate so as to obtain the luminance 340 cd/m$^2$ which is obtained when the display load rate is 25%. In other words, In case of the display load rate of 50%, 67 compensation cycles, i.e., 67 compensation discharges, are required, in case of the display load rate of 75%, 67 and 87 compensation cycles are required, in case of the displaying load rate of 100%, 67, 86 and 119 compensation cycles are required.

Figure 15:
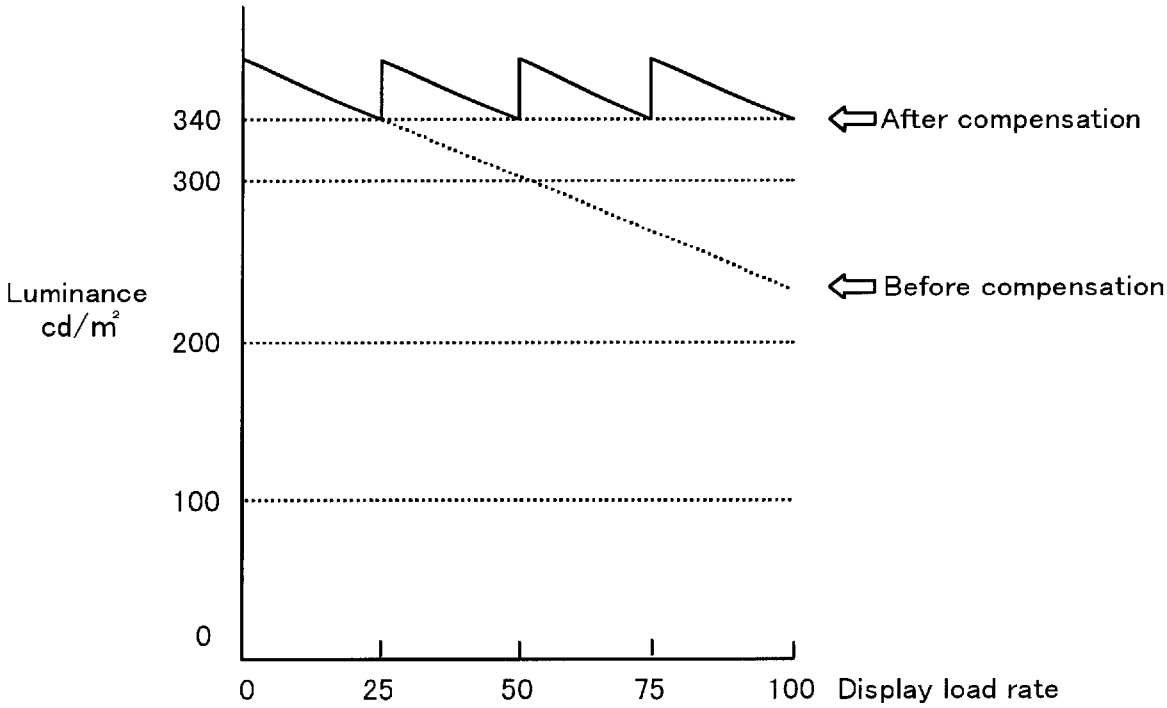
FIG. 15 shows a relationship between a display load rate and the compensated luminance.

FIG. 15 shows a relationship between the display load rate and the compensated luminance. The luminance after compensating with each display load rate by adding the number of the compensation cycles, as shown in FIG. 14, can be shown by a bold line. In FIG. 15, the luminance before compensation is shown by a broken line. In this way, more than 340 cd/m$^2$ of luminance can be generated for all display load rates, by adding the compensation cycle shown in FIG. 14, as shown in FIG. 15.

Figure 16:
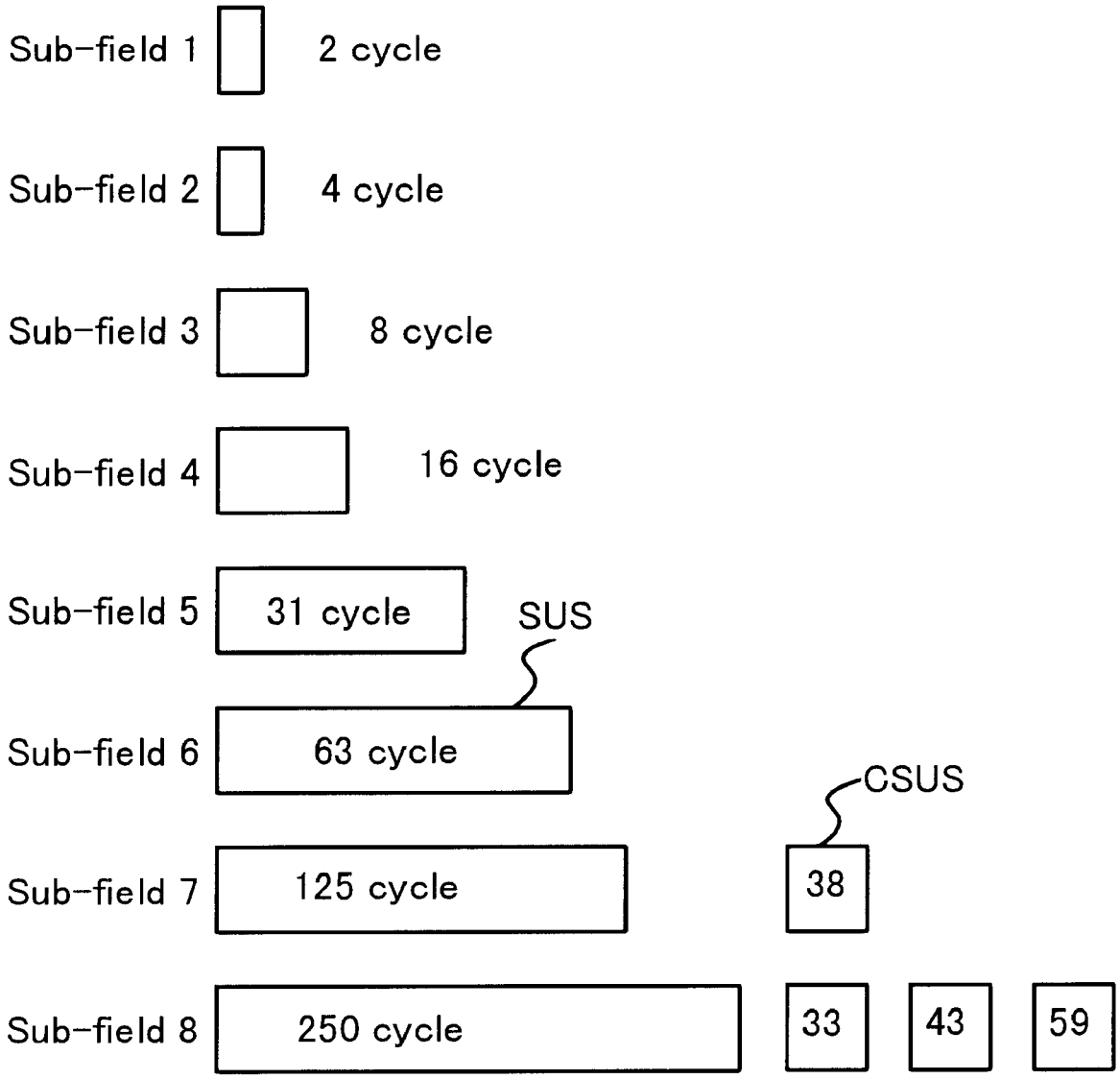
FIG. 16 shows an example of a luminance compensation cycle, which is added for eight sub-fields.

FIG. 16 shows an example of the luminance compensation cycle added for eight sub-fields. An example applying the embodiment of the present invention to a driving sequence for eight sub-fields having 256 gradation display, according to the result of FIG. 14 is shown in FIG. 16. In this example, the ratio of the sustain discharge periods, i.e., a number of the sustain cycles, of eight sub-fields becomes 1:2:4:8:16:32:64:128:256, to display the difference of the 256 gradations, thus being 500 cycles in total. Therefore, the number of the sustain cycles SUS in each sub field is set to 2, 4, . . . 125, 250 cycles as shown in FIG. 16, the 38 luminance compensation cycles are given to the sub-field 7. Additionally, the 33, 43 and 59 luminance compensation cycles are set for the sub-field 8.

A luminance compensation period, to which one erase pulse and 38 sustain discharge pulse are applied, is added to the sub-field 7. One erase pulse and 33 sustain discharge pulses, one erase pulse and 43 sustain discharge pulses, and one erase pulse and 59 sustain discharge pulses are continuously added to the sub-field 8. In this way, it becomes possible to provide a luminance compensation according to the insufficiency of luminance in each cell by dividing the luminance compensation period according to the three erase pulses in the sub-field 8. As shown in the example of FIG. 5, it is possible to make the luminance value after compensation shown by a bold line in FIG. 15 have a plain characteristic not a saw-tooth characteristic by applying the erase pulse in each sustain discharge pulse, i.e., in each two sustain discharge pulse in the compensation period as in the example of FIG. 5. However, there is no need for human being to compensate exactly. Therefore, in reality, it is enough to apply the erase pulse and plural sustain discharge pulses thereafter as shown in FIG. 16, and it is better to simplify the drive in one frame period.

Additionally, as the luminance difference caused by the display load rate difference is not so large when the luminance is lower as in the sub-fields 1 to 6, a luminance compensation cycle is not provided to such sub-fields in the example of FIG. 16. The sub-field 7 is set so as to apply one erase pulse and 38 sustain discharge pulses following to the erase pulse, so that the sustain discharge for luminance compensation is added, when the display load rate is 50%, for example. Therefore, the pulse width on the rising characteristic of the erase pulse is suitably set corresponding to the above-setting.

The sub-field 8 where the sustain discharge period is longer than any other periods will be now explained in accompanying to the example of FIG. 16. At first, during the same sub-field period, a luminance compensation discharge occurs for a longer time in the display line where a display load rate is higher, and a luminance compensation discharge occurs for a shorter time in the display line where a display load rate is lower. This means, in case the common X electrodes are divided in the display panel, the luminance compensation discharge occurs for a shorter time in the area where the display load rate is higher, and the luminance compensation discharge occurs for a shorter time in an area where the display load rate is lower.

Secondly, in case where, for different sub-field periods, display load rates are the same between display lines or display areas in each sub-field period, and the display load rates are different between different sub-field periods, the luminance compensation discharge occurs for a longer time in the period where the display load rate is higher, and the luminance compensation discharge occurs for a shorter time in the period where the display load rate is lower.

The number of the above-described luminance compensation discharges is automatically allocated to the most suitable number according to the erase pulse.

Figure 17:
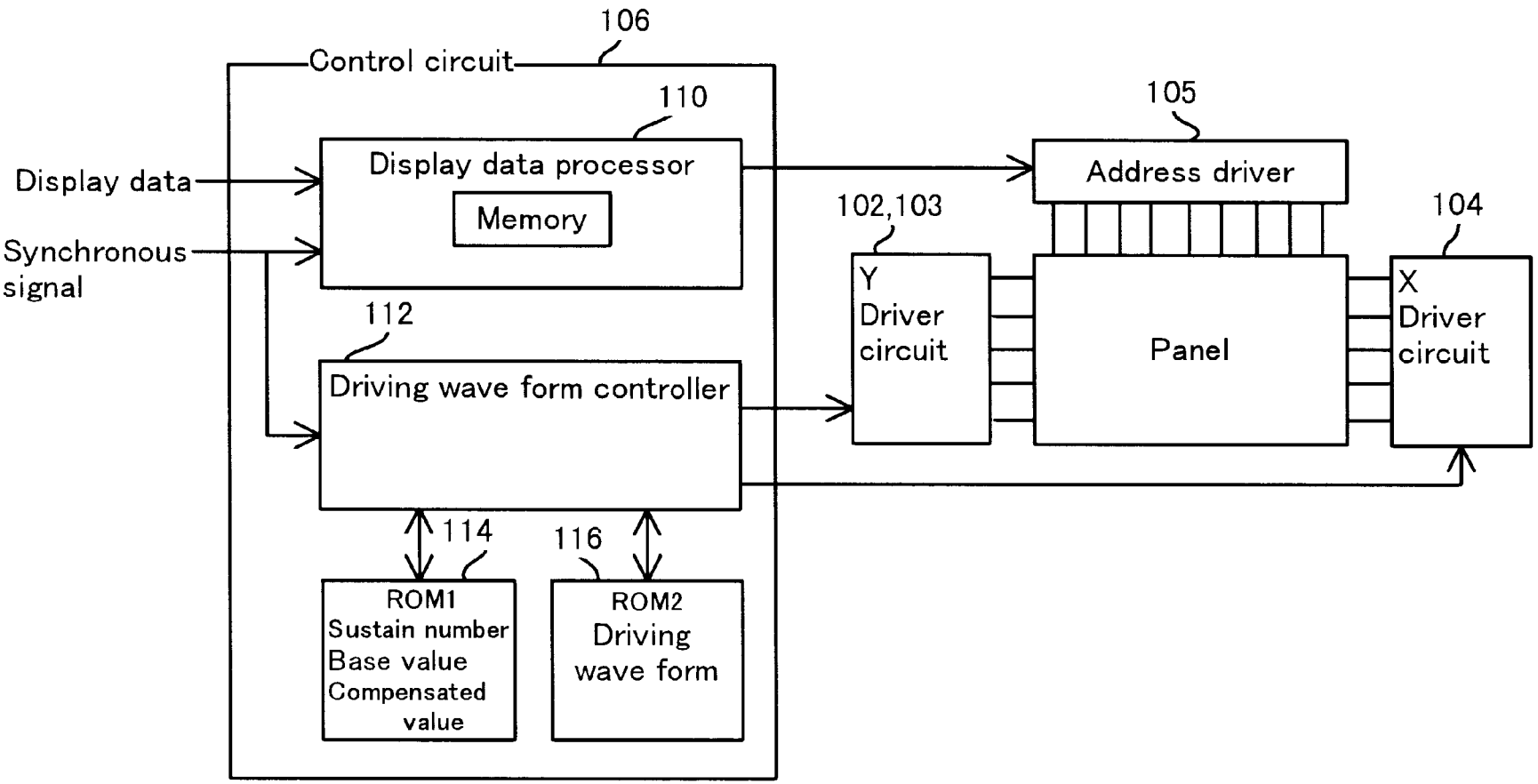
FIG. 17 shows a structural example of a display device when generating a luminance compensation discharge according to an embodiment of the present invention.

FIG. 17 shows a structural example of a display device when generating the luminance compensation discharge in the above-described embodiment. In the embodiment of the present invention, an adjusting period for the sustain discharge after the normal sustain discharge period is provided. Therefore, the display device has a controller 106 to drive and control a panel in the adjusting period. In FIG. 17, the same reference numbers are given to the parts corresponding to those of FIG. 4. The display device in the structural example of FIG. 17 has a display data processor 110 for inputting the display data supplied in the controller 106, accumulating the data in the memory once, and transmitting the address data to the address driver 105 in each sub-field, and a driving waveform controller 112 for outputting the driving waveform for driving each electrode in the panel and controlling the driver circuits. Further, the controller 106 has two ROMs 114 and 116. These ROMs 114 and 116 are referred by the driving waveform controller 112 to employ the generation of the driving waveform.

The driving waveform controller 112 controls each driving circuit according to timing information for deciding the timing of switching a driving transistor in the driver circuit stored in the ROM 2. Each driver circuit is controlled so as to generate a suitable number of sustain discharges in each sub-field, according to a basic value of the number of the sustain discharges in each field stored in the ROM 1. A compensation value for adjusting the sustain discharge is also stored in the ROM 1. Therefore, the driving waveform controller 112 makes the driver circuit generate the additional sustain discharges for luminance compensation required after the normal sustain discharge, according to the compensation value. The waveform of the erase pulse in the luminance compensation period can be realized by controlling the driving circuit, according to the timing information stored in the ROM 2.

As is explained, according to the present invention, it becomes possible to solve a generation of uneven luminance caused by a difference of display load rates between display lines, the display areas, or the display periods, by providing a luminance compensation discharge period comprising an erase pulse and an additional sustain discharge pulse following to the erase pulse.

What is claimed is:

1. A plasma display device comprising:

a display panel including plural cells selectively discharged according to display data; and a driver circuit coupled to the display panel and defining an address period in which respective address discharges are generated at selected cells of plural display lines according to the display data, a sustain discharge period in which sustain discharges are generated at each of the selected cells where the respective address discharges are generated by applying sustain discharge pulses alternately between X and Y electrodes provided along the display lines, and a luminance compensation discharge period in which respective luminance compensation discharges are generated in at least a part of the selected cells by applying, plural times, a pair of an erase pulse and an additional sustain discharge pulse following the erase pulse between the X and Y electrodes.

2. The plasma display device according to claim 1, wherein, in the luminance compensation discharge period, the erase pulse is either of a lower voltage than the sustain discharge pulse or of a narrower width than the sustain discharge pulse.

3. The plasma display device according to claim 1, wherein, in the luminance compensation discharge period, the erase pulse rises at a gentler gradient than the sustain discharge pulse.

4. The plasma display device according to claim 1, wherein, in the luminance compensation discharge period, in response to applying the erase pulse and the additional sustain discharge pulse, the luminance compensation discharge is generated in a first display line where the address discharges are generated at M cells and the luminance compensation discharge is not generated in a second display line where the address discharges are generated at N cells (where M>N).

5. The plasma display device according to claim 1, wherein:

the X electrodes are commonly provided for plural display lines and the sustain discharge pulses are applied to the commonly provided X electrode, and in the luminance compensation discharge period, in response to the erase pulse and the additional sustain discharge pulse, the luminance compensation discharge is generated when the address discharges are generated at K cells and the luminance compensation discharge is not generated when the address discharges are generated at L cells (where K>L).

6. The plasma display device according to claim 1, wherein the erase pulse, applied the plural times, comprises a first erase pulse having a first voltage or a first pulse width and a second erase pulse generated after the first erase pulse, having a second voltage or a second pulse width which is smaller than the first voltage or the first pulse width.

7. The plasma display device according to claim 1, wherein the erase pulse, applied the plural times, includes erase pulses having different rising characteristics.

8. The plasma display device according to claim 1, wherein following the erase pulse, applied the plural times, one or more sustain discharge pulses is or are applied and a number of cycles of the one or more sustain discharge pulses for one time of the plural times is different from other times of the plural times.

9. The plasma display device according to claim 1, wherein following the erase pulse, applied the plural times, one or more sustain discharge pulses is or are applied and a number of cycles of the one or more sustain discharge pulses for each subsequent time of the plural times is increased compared to a previous time of the plural times.

10. The plasma display device according to claim 1, wherein the driver circuit causes the address discharge and the sustain discharge at a prescribed cell in plural sub-fields each having a sustain discharge period weighted according to a gradation of a luminance, and causes the luminance compensation discharge in a part of the sub-fields corresponding to a higher gradation than a prescribed gradation.

11. The plasma display device according to claim 10, wherein among the sub-fields corresponding to the higher gradation than the prescribed gradation, the erase pulse and the additional sustain discharge pulse following the erase pulse for the luminance compensation discharge are applied a first time in a first sub-field corresponding to a first gradation, and the erase pulse and the additional sustain discharge pulse following the erase pulse for the luminance compensation discharge are applied a second time for a longer duration than the first time in a second sub-field corresponding to the higher gradation than the first gradation.

12. A method of driving a plasma display panel including plural cells being selectively discharged according to display data, comprising:

generating, in an address period, address discharges at selected cells according to the display data;

generating, in a sustain discharge period, sustain discharges at the selected cells where the address discharges are generated by applying sustain discharge pulses alternately between X and Y electrodes provided along display lines; and generating, in a luminance compensation discharge period, luminance compensation discharges in at least a part of the selected cells by applying, plural times, a pair of an erase pulse and an additional sustain discharge pulse following the erase pulse between the X and Y electrodes.

13. A plasma display device comprising:

a display panel including plural cells being selectively discharged according to display data; and a driver circuit coupled to the display panel and producing an address discharge at a cell according to the display data, a sustain discharge at each cell where the address discharge is generated by applying sustain discharge pulses alternately between X and Y electrodes provided along the display lines, and a luminance compensation discharge at, at least, a part of the cells by applying an erase pulse and an additional sustain discharge pulse following the erase pulse between the X and Y electrodes, the erase pulse rising at a gentler gradient than the sustain discharge pulse.

14. A plasma display device comprising:

a display panel including plural cells being selectively discharged according to display data; and a driver circuit coupled to the display panel and producing an address discharge at a cell according to the display data, a sustain discharge at each cell where the address discharge is generated by applying sustain discharge pulses alternately between X and Y electrodes provided along the display lines, and a luminance compensation discharge at, at least, a part of the cells by applying an erase pulse and an additional sustain discharge pulse following the erase pulse between the X and Y electrodes in response to applying the erase pulse and the additional sustain discharge pulse, the luminance compensation discharge is generated in a first display line when the address discharges are generated at M cells and the luminance compensation discharge is not generated in a second display line when the address discharge are generated at N cells (where M>N).

15. A plasma display device comprising:

a display panel including plural cells being selectively discharged according to display data; and a driver circuit coupled to the display panel and producing an address discharge at a cell according to the display data, a sustain discharge at each cell where the address discharge is generated by applying sustain discharge pulses alternately between X and Y electrodes provided along the display lines, and a luminance compensation discharge at, at least, a part of the cells by applying an erase pulse and an additional sustain discharge pulse following the erase pulse between the X and Y electrodes, the X electrodes are commonly provided for plural display lines and the sustain discharge pulses are applied to the commonly provided X electrode, and in response to applying the erase pulse and the additional sustain discharge pulse, the luminance compensation discharge is generated when the address discharges are generated at K cells and the luminance compensation discharge is not generated when the address discharges are generated at L cells (where K>L).

16. A plasma display device comprising:

a display panel including plural cells being selectively discharged according to display data; and a driver circuit coupled to the display panel and producing an address discharge at a cell according to the display data, a sustain discharge at each cell where the address discharge is generated by applying sustain discharge pulses alternately between X and Y electrodes provided along the display lines, and a luminance compensation discharge at, at least, a part of the cells by applying an erase pulse and an additional sustain discharge pulse following the erase pulse between the X and Y electrodes, the driver circuit causes the address discharge and the sustain discharge at the prescribed cell in plural sub-fields each having a sustain discharge period weighted according to a gradation of the luminance, and causes the luminance compensation discharge in a part of the sub-fields corresponding to a higher gradation than a prescribed gradation, and among the sub-fields corresponding to the higher gradation than the prescribed gradation, the erase pulse and the additional sustain discharge pulse following the erase pulse for the luminance compensation discharge are applied a first time in a first sub-field corresponding to a first gradation, and the erase pulse and the additional sustain discharge pulse following the erase pulse for the luminance compensation discharge are applied a second time for a longer duration than the first time in a second sub-field corresponding to the higher gradation than the first gradation.

* * * * *